US005334026A

United States Patent [19]

Ylitalo

[11] Patent Number: 5,334,026

[45] Date of Patent: Aug. 2, 1994

[54] MANUAL SLIDING CALCULATOR

[76] Inventor: Howard Ylitalo, 2500 Montgomery Ave. SW., Cokato, Minn. 55321

[21] Appl. No.: 72,048

[22] Filed: Jun. 7, 1993

[51] Int. Cl.[5] ..... G06C 1/00

[52] U.S. Cl. ..... 434/203; 434/207; 434/113

[58] Field of Search ..... 434/203, 204, 207, 188, 434/113

[56] References Cited

U.S. PATENT DOCUMENTS

| | | | |
|---|---|---|---|
| 465,811 | 12/1891 | Anderson | 434/203 |
| 541,787 | 6/1895 | Hegewald et al. | 434/203 |
| 1,099,009 | 6/1914 | Bennett | 434/203 |
| 1,718,694 | 6/1929 | Kurowski | 434/113 |
| 3,076,272 | 2/1963 | Schott | 434/203 |
| 3,092,917 | 6/1963 | Podell | 434/203 |
| 4,812,124 | 3/1989 | Colodner et al. | 434/203 |

*Primary Examiner*—Gene Mancene
*Assistant Examiner*—Jeffrey A. Smith
*Attorney, Agent, or Firm*—Leo Gregory

[57] ABSTRACT

An early age abacus type teaching device comprising a rod having movable counters thereon with corresponding sequentially spaced numerals therealong whereby the numerals are utilized to represent the calculation of the preceding manipulated counters and the rod is equipped at each end thereof with a device to support and hold the same upon a horizontally or vertically disposed surface.

4 Claims, 4 Drawing Sheets 10
11
11a
12
13
14
15
16
20
20a
0 1 2 3 4 5 6 7 8 9 10 11 12 13 14 15 16 17 18 19 20
21 22 23 24 25 26 27 28 29 30 31
2A
2A 3
2
+1
6
4
×2
8
5
-2
3
4
2
8

40
13
20'21'
20a
20
42
21
12
15
40
13
20
42
21
16'
40
12
10 9 8 7 6 5 4 3 2 1 0 -1 -2 -3 -4 -5 -6 -7 -8 -9
16
13
11 12 13 14 15 16 17 18 19 20 21
27
27

MANUAL SLIDING CALCULATOR

BACKGROUND OF THE INVENTION

1. Field of Invention

This invention relates to a single rod calculating device having movable counters thereon and corresponding sequentially spaced numerals on said rod.

2. Description of the Prior Art

An abacus is an early development of a manually operable calculating device comprising a plurality of spaced vertically disposed strings having thereon movable counters but there was not present any resulting reading of a calculation.

Where a pupil can physically carry out a calculating function and see what he is doing, the mental process of absorbing and understanding the method of calculating and its result is greatly expedited. This has been attested to by teachers involved in teaching arithmetic to very early grade school children.

SUMMARY OF THE INVENTION

This invention relates to a calculating device for early grade school children wherein a hands-on approach supplements and combines with the usual visual and mental processes to expedite the learning process from an explanation and illustration on a blackboard.

The invention comprises a rod having individual counters or collars thereon of a sufficient number to accommodate simple arithmetic functions with the corresponding numerals.

By way of example, each fifth counter or collar is colored to display groups of five. For subtraction, let us assume there are ten counters at the left hand end of the rod with the numeral 10 on the rod being visible just to the right of the tenth counter. The calculation is to subtract five. The student moves five counters to the right and the numeral five appears on the rod just to the right of the remaining collars and that is the result or answer. Both mental and physical processes were used.

For addition of five and five, five collars would be moved to the left end of the rod and then five more are moved over with the result appearing just to the right of the tenth counter moved, the result being the numeral 10.

For multiplication, all collars are moved to the right of the rod. To multiply four by three, move three sets of four counters each to the left and the disclosed result is twelve shown at the right of the twelfth counter by the numeral on the rod adjacent thereto.

For division, with the counters at the right hand end of the rod, slide nine collars to the left as the dividend, with a divisor of three, separate the nine collars into groups of three to arrive at the quotient or the answer of three-there being three separated groups of three.

The operation carried out by the student at his desk, in a very real manner, supplements the visual operation of a blackboard demonstration with the mental comprehension of it. Thus the whole learning process for arithmetic is both supplemented and expedited.

For students who are not sighted, braille characters are present on the rod in conjunction with the visual numerals.

For ease in using the abacus rod as on a desk, suction cups are provided at each end thereof to elevate the rod for free movement of the counters and for securing the rod from sliding about.

Thus it is the desire to provide a very simply operated learning device for arithmetic functions to expedite and supplement by doing, the otherwise usual learning process of just seeing and hearing.

BRIEF DESCRIPTION OF THE DRAWINGS

FIGS. 3-10 are segmental portions in front elevation showing various arrangements of specific portions thereof which relate to the description thereof given in the specifications;

FIG. 15 is a view in front elevation showing a modification;

FIG. 16 is a view in horizontal section in two parts showing the modification;

FIG. 17 is a view partially in section taken on line 17—17 of FIG. 16 as indicated.

DESCRIPTION OF A PREFERRED EMBODIMENT

Reference is had to applicant's pending application Ser. No. 963,742 filed May 20, 1991, now reissue U.S. Pat. No. Re 34,498, over which the present application represents modification and improvement.

Figures 1, 1A, 2, 2A:
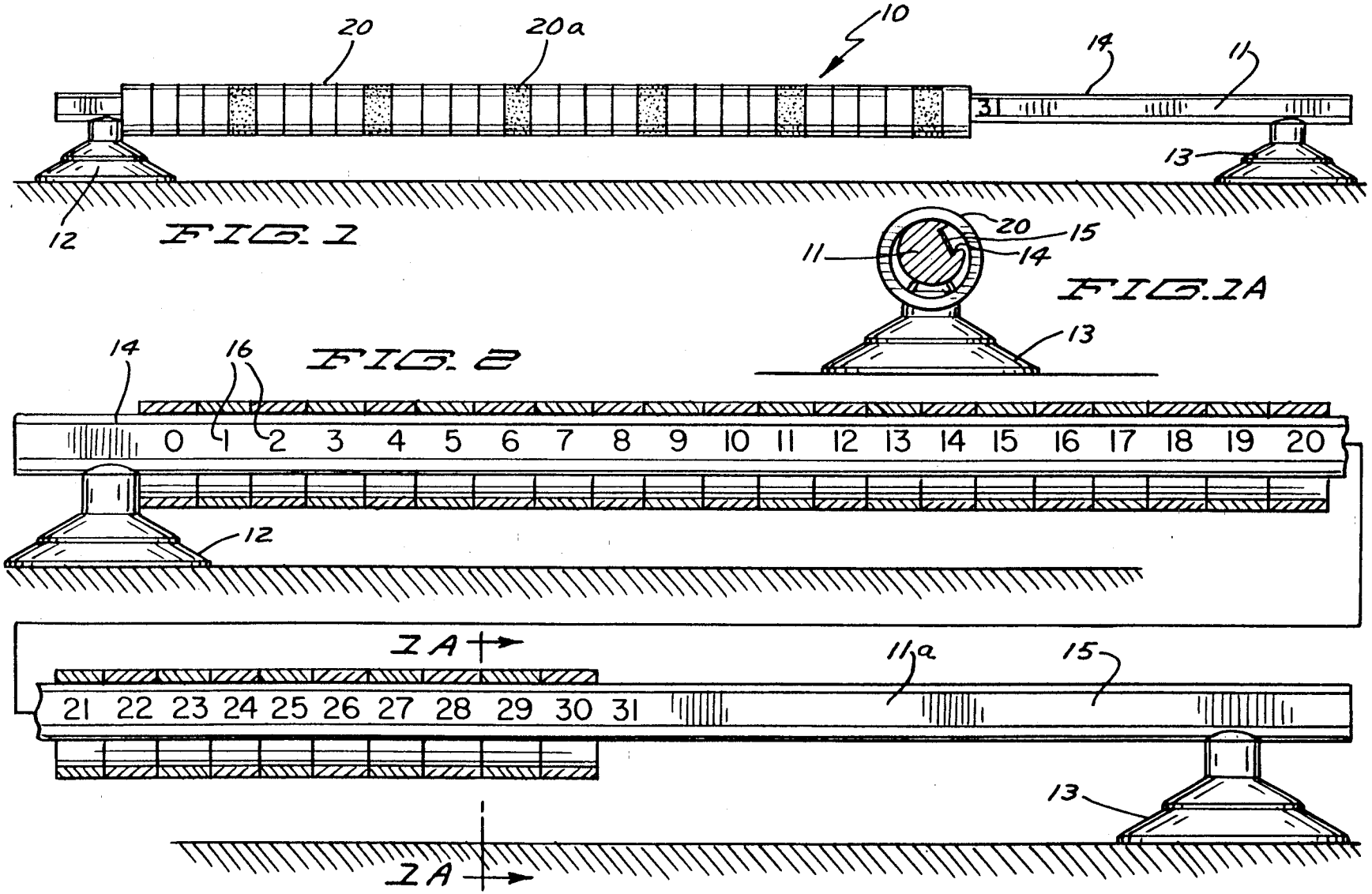
FIG. 1 is a view in front elevation.
FIG. 1A is a view partially in cross section taken on line 1A—1A of FIG. 2 as indicated showing the relative size of the parts.
FIG. 2 is a view in longitudinal vertical section of the invention in two parts.

Referring to the drawings and more particularly to FIG. 1, the calculating or arithmetic teaching device comprising the invention herein is indicated generally by the reference numeral 10.

Said device as illustrated here is made up of a rod member 11. Said rod is preferably formed of wood but it may be extruded as a plastic or like member as may be desired. For purpose of description of the embodiment herein, the rod is indicated as being on the order of twenty inches in length and on the order of one half inch in diameter. Adjacent each end of said rod are support members 12 and 13 here shown to be flexible plastic suction cups which are suitably secured to said rod by recessed screws which are not here shown.

Said suction cups hold the rod firmly as upon a desk top for use thereof Without having it slide about.

Extending the full length of a facing side of said rod is a recessed slot 14 having secured therein a self-securing strip 15 bearing numerals 16 here shown as being from one through thirty-one. This is an arbitrary number for purpose of illustration.

Figure 11:
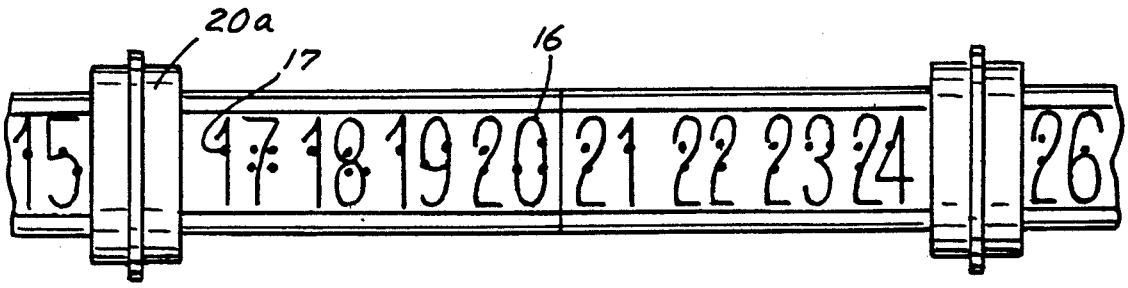
FIG. 11 is a broken view in front elevation on an enlarged scale showing a detail.

Embossed and appearing on said strip, as shown on an enlarged scale in FIG. 11, are braille characters 17 corresponding to said numerals. These are applied for use by a child who is not sighted.

Mounted to be movable on said rod are counters or collars 20 which will conform to the rod but are here indicated as being circular in form and of a size to be readily slidable along said rod. For ease of engagement and manipulation each of said counters may have a central annular projecting rib 20*a* in FIGS. 11–13 or if preferred this may simply be in the form of a projecting tab not here shown.

Said counters will correspond in number to the number of numerals appearing on said strip 15. Preferably the counters are formed of a rigid plastic material. For convenience, each fifth counter 20*a* is colored so that a child can easily see and have readily indicated to him groups of five counters.

The unnumbered right hand end 11*a* of said rod 11 is simply space to receive counters not being used for calculation purposes.

With the counters positioned to the left, the corresponding number for each counter will appear to the right thereof.

A description of the operation will now be given. Some simple calculations were given in the Summary hereof and similar examples follow.

Figures 4, 5, 6, 7, 8, 9, 10:
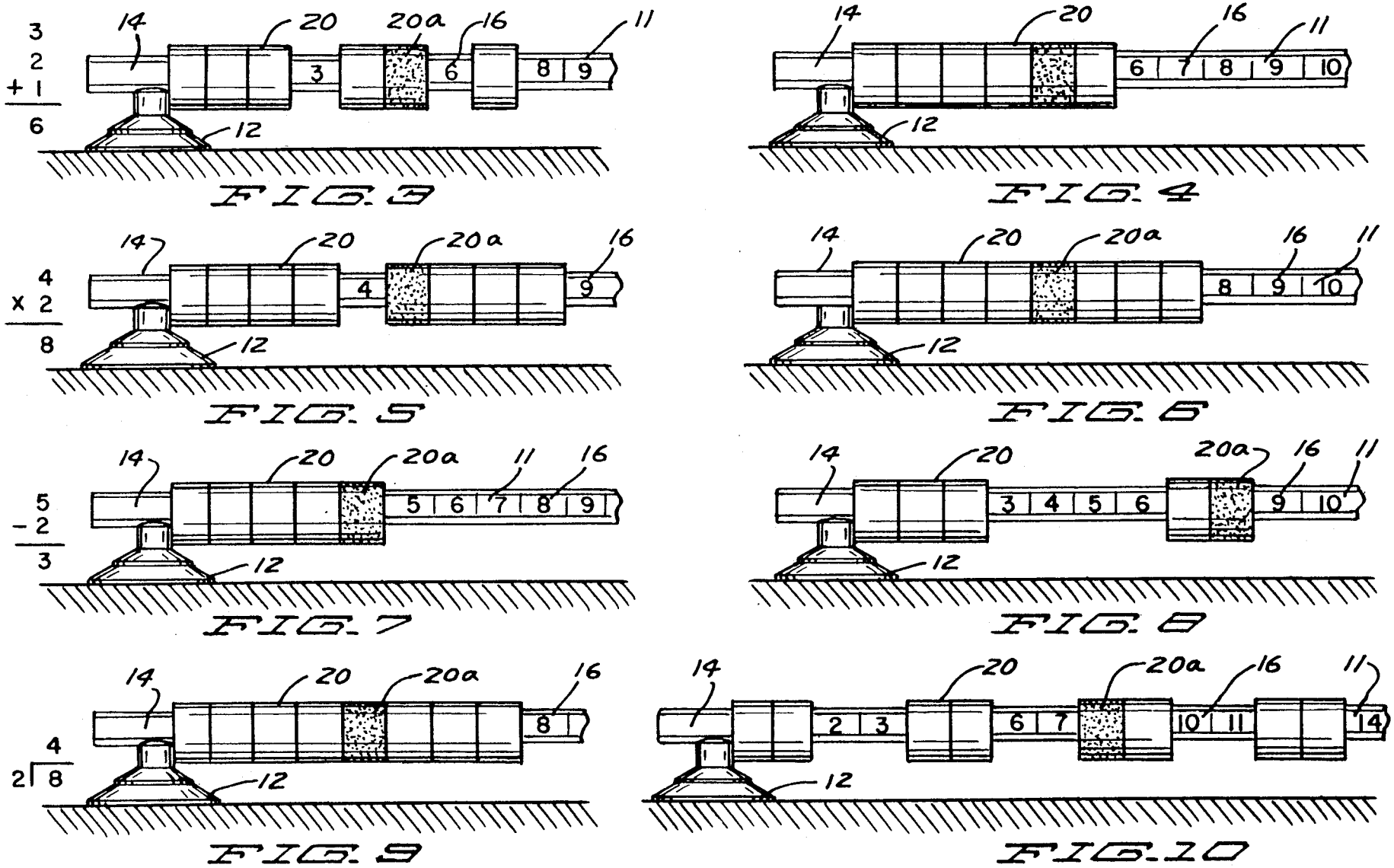

For addition, refering to FIGS. 3 and 4, to add three, two and one, from the counters moved to the right, move three collars to the left end of the rod. The child operator should be told to watch the numbers as the counters are moved. When each counter is moved, its corresponding number will appear to its right. Then two collars are moved to the left and finally a single collar will be moved. The operator will note the number appearing at the right of the last moved counter will be 6 which is the answer. This is obvious to the reader but it must be borne in mind that the small child operator has had no formal experience in counting and in working out calculations.

For multiplication, refer to FIGS. 5 and 6. The counters are at the right hand end of the rod. The problem is to multiply four times two. Hence the child operator first moves a group of four counters or one at a time until the numeral four appears at the right of the last moved counter. Then the next group of four counters are moved to join the first group moved and the numeral eight will appear to the right of the last counter moved. Thus sets of four counters moved twice or two times four equals eight. The elements of seeing and doing in registering with the child operator mentally carry out the learning process resulting from the use of the invention.

To illustrate subtraction, FIGS. 7 and 8, the problem will be to take two away from five. It is to be understood that in teaching the use of the device, a teacher may have a very much enlarged model for demonstration.

The child either first counts five, one by one or moves a group of five to the left end of the rod. The group of five being indicated by a colored counter. The number five will be seen at the right of the group. The child next takes away two from the group of five moving the two to the right. The numeral three will appear to the right of the remaining counters which is the answer.

Referring to FIGS. 9 and 10, an example in division will be given. The problem will be to divide eight by two.

The child operator is instructed to move eight counters to the left end of the rod. He can move the first group of five indicated by a colored counter and then move additional counters until the numeral eight appears at the right end most of the moved counters. The teacher or instructor will explain that two will go into eight just as many times as groups of two can be taken away from eight. The child operator is then instructed to count out the right hand two counters of those just moved and move them to the right. Then the child operator will be instructed to move an additional two sets of two counters each to the right. This with three total sets of two counters each having been moved to the right and one set remaining, there are thus four groups of two each making eight, eight divided by two equals four. The number of separated groups make clear the answer. Thus the quotient is four.

Thus here the child operator has the visual experience of the physical counting and the absorbtion of it mentally. This makes a real impact on the learning process of the child.

As above indicated, and shown on an enlarged scale in FIG. 11, braille characters 17 have been provided on the strip 15 so that a child who does not have the benefit of sight can physically follow the above instructions and read the numerals at the right of the counters as indicated by touching the same.

MODIFICATIONS

Figure 12:
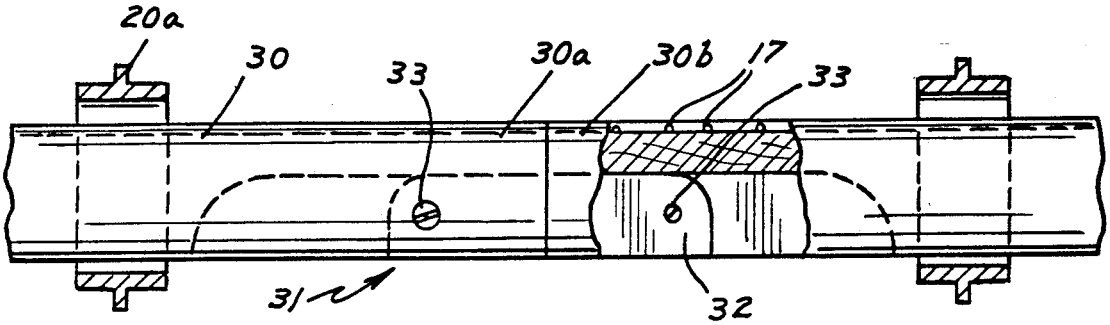
FIG. 12 is a broken view in side elevation and partially in section and partially in dotted line indicating a detail of structure.
Figure 13:
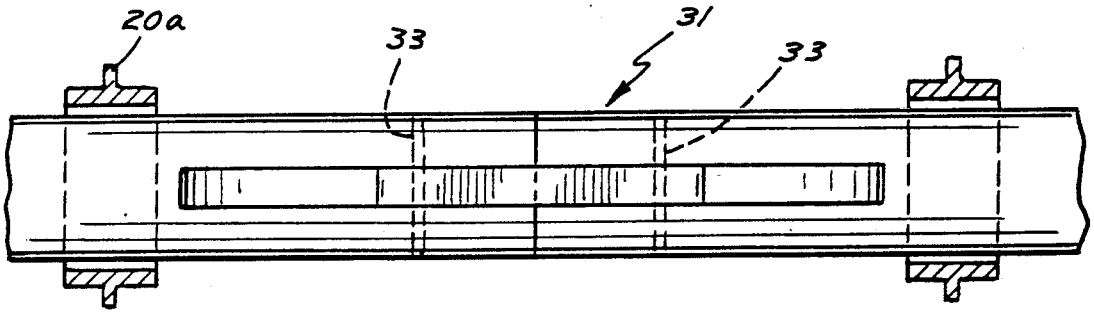
FIG. 13 is a bottom plan view partially in section and partially in dotted line showing a detail of structure.
Figure 14:
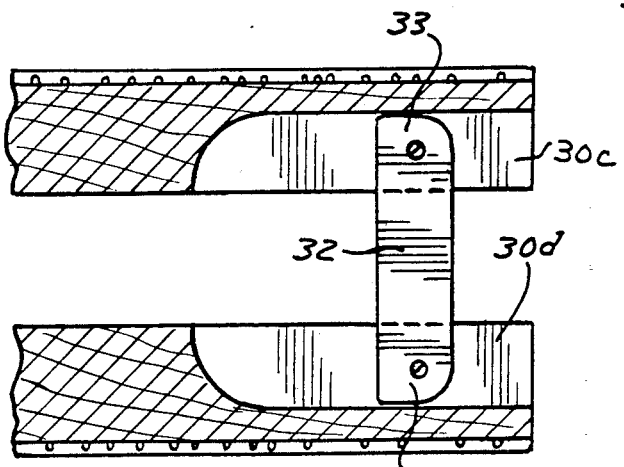
FIG. 14 is a broken view in section showing a detail of structure.

For demonstration purposes or where it is deemed desirable to have an enlarged model, the same is provided by the rod 30, FIGS. 12–14, which but for one exception is that because of its greater length, it is more conveniently carried about by having a midpoint hinge 31 which connects adjacent rod sections or ends 30*a* and 30*b*. At the bottoms or rear sides of said adjacent ends and extending thereacross are aligned slots 30*c* and 30*d*. Extending across the juncture of said slots and being seated therein to a hinge plate 32 secured adjacent each end thereof by pins or screws 33 extending transversely through said adjacent ends and the slots therein as shown. Thus a hinge is formed whereby said rod may be conveniently folded double rearwardly and thus becomes easier to carry.

Another modification is shown in FIGS. 15–17 wherein a rod 40 is shown having negative numerals in addition to positive numerals but in other respects is the same as the rod 11.

Referring to rod 40, a marker shown here as pin 42 extends transversely therethrough at a point where a numeral on said rod is designated as zero (0) in the scale of numerals and those numerals 16 to the right thereof in ascending order are positive and those numerals 16' to the left thereof, also in ascending order, are negative. The corresponding counters for the positive numerals bear the reference numeral 20 and the corresponding counters for the negative numerals bear the reference numeral 21.

Here in teaching a child the use of negative numerals, a problem is presented of adding a positive eight and a negative four. The child is instructed, to move eight positive counters 20 to the left to abut the pin 42 and the numeral eight will be at the right of the eighth counter. Next, the child will be instructed to move four negative counters 21 to the right to abut the pin 42 at the left thereof and the negative numeral four will be seen at the left of the fourth counter. It is understood that in starting, all positive counters are moved to the right and the negative counters to the left.

Now to arrive at the answer. The basic rule is that to add, you count to the right and to subtract you count to the left from the end most counter.

For doing addition, starting with the left most negative counter 21 as the fourth one, you count eight counters to the right and at that point you move away the remaining positive counters and the answer as indicated by the numeral at the right of the last counted or eighth counter is four. Four is the answer and more specifically it is a plus four.

To subtract, the problem is to subtract a negative six from a positive three. The child is instructed to move three positive counters 20 to the left to abut the pin 42 and to move six negative counters 21 to the right to abut the pin 42. Then starting with the third positive counter, the child counts six counters to the left and moves away the uncounted negative counters. The numeral to the left of the negative counters is a negative three and that is the answer. These computations are not illustrated.

It is the combination of the mental and physical or manual process in moving the counters which makes an impact on the child in this learning process and it has proved to be a very successful one.

Figure 18:
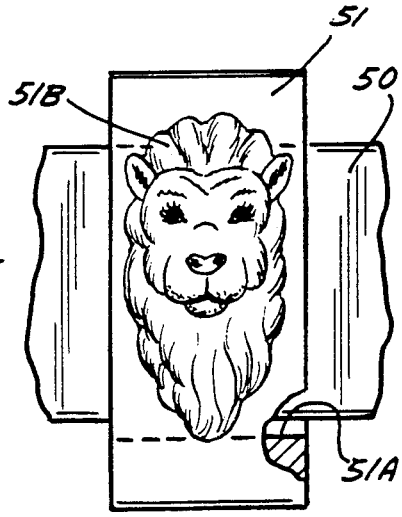
FIG. 18 is a view in elevation showing a modification of a counter.
Figures 25, 26, 27:
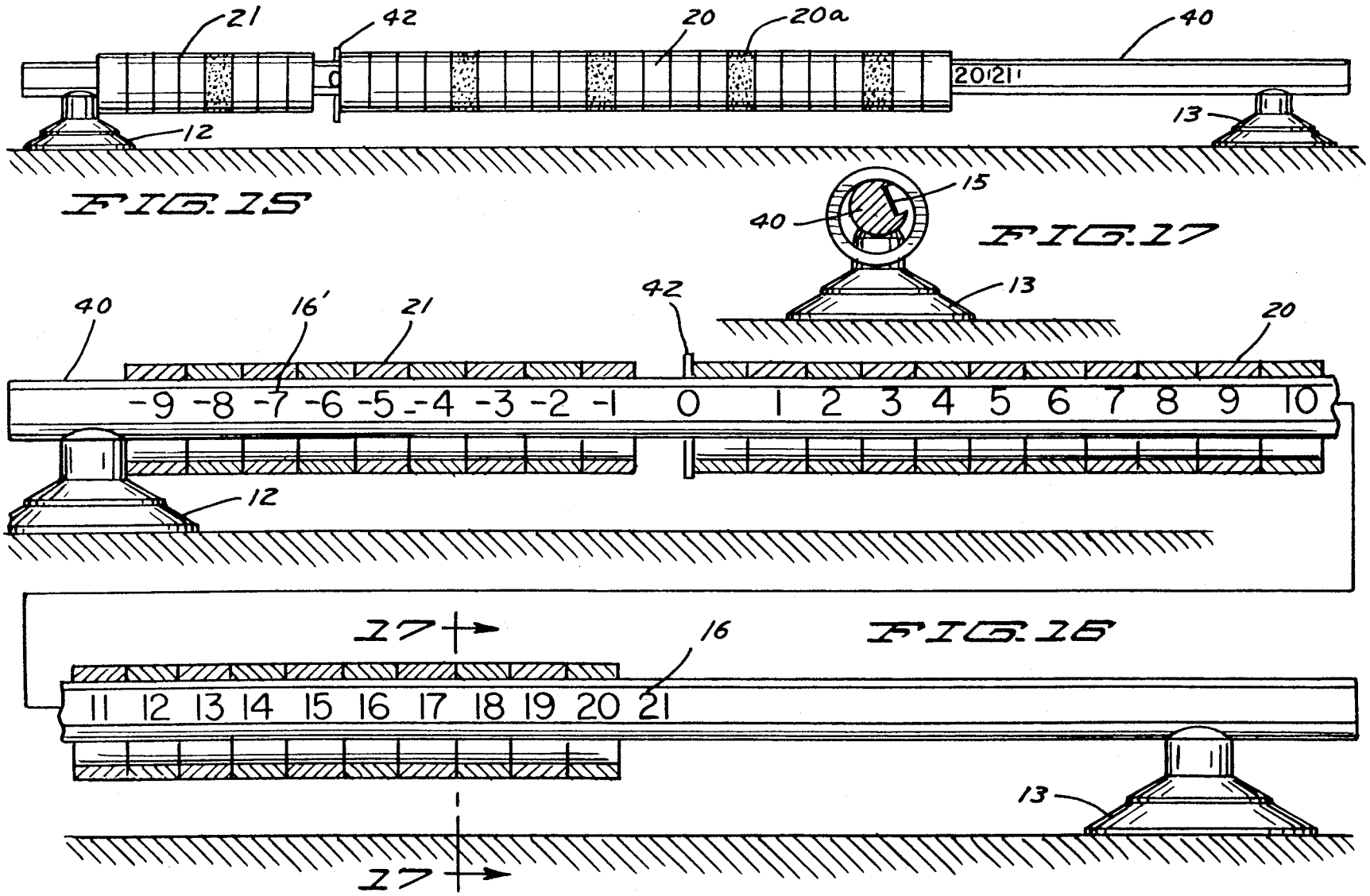

In a further modification, referring to FIG. 18, shown in a fragmentary view in elevation on an enlarged scale is a rod member 50 which is non-circular in cross section as shown and the same represents a modification of the rod member 11 and carried thereon as representative of other like counters is a counter 51 having a bore 51*a* which in cross section is compatible with the configuration of the rod member 50 and is readily slidable thereon.

The counters in the FIGS. 1–10 are shown having plain fairly smooth outer surfaces except for each fifth counter which is colored.

In an effort to arouse a greater degree of interest of the beginning graders who are being taught simple calculations, the counters on their forwardly facing sides have a particular design formed thereon. The design, such as the animal head 51*b*, will pique the interest of a child. It will be understood that the design 51*b* in FIG. 18 simply a representative head and this may be varied according to the interest of the designer. Thus it is submitted this effect will whet the appetite of an early school grader in learning his beginning calculations.

Although not here shown, in using a rod of a fairly large size for demonstration purposes, eyelits may be screwed into the ends of a rod for hanging as on a wall or blackboard. As has been indicated, the size, length and the number of counters used are all subject to what is desired in a particular situation.

It will of course be understood that various changes may be made in the form, details, arrangement and proportions of the product without departing from the scope of the invention, which generally stated, consists in an apparatus capable of carrying out the objects above set forth, such as disclosed and defined in the appended claims.

What is claimed is:

1. A manually operable calculating device, having in combination a single rod, a suction cup affixed adjacent each end of said rod elevating and supporting the same secured in a non-slidable position on horizontally and vertically disposed surfaces, a recessed slot extending along said rod, a strip bearing numerals in sequence disposed into said slot, a plurality of counters carried on said rod slidable therealong, and an end portion of said rod not bearing numerals to provide space to receive unused counters.

2. The structure of claim 1, wherein each fifth one of said counters is colored.

3. A manually operable calculating device, having in combination a single rod, securing means adjacent each end of said rod elevating and supporting the same in a non-slidable position, a recessed slot extending along said rod, a strip bearing numerals in sequence disposed into said slot, a plurality of counters carried on said rod slidable therealong, an end portion of said rod not bearing numerals to provide space to receive unused counters, said rod having a joint therein whereby said rod may be folded for carrying purposes.

4. A manually operable calculating device, having in combination a single rod, suction means adjacent each end of said rod elevating and supporting the same secured in a non-slidable position upon a horizontally or vertically disposed surface, a recessed slot extending along said rod, a strip bearing numerals disposed in said slot, a pin extending transversely through said rod indicates a numeral zero (0) position on said strip, to the right of said pin said strip bears positive numerals and to the left of said pin said strip bears negative numerals.

* * * * *